US006329752B1

(12) United States Patent
Choi

(10) Patent No.: US 6,329,752 B1
(45) Date of Patent: Dec. 11, 2001

(54) PLASMA DISPLAY PANEL OF SEPARATION DRIVE TYPE

(75) Inventor: Kyung-woo Choi, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/549,179

(22) Filed: Apr. 13, 2000

(30) Foreign Application Priority Data

Jun. 9, 1999 (KR) ..... 99-21365

(51) Int. Cl.[7] ..... H01J 17/49
(52) U.S. Cl. ..... 313/585; 313/586
(58) Field of Search ..... 313/582, 583, 313/584, 585, 586, 587, 238, 243, 245, 483, 495

(56) References Cited

U.S. PATENT DOCUMENTS 5,663,611 * 9/1997 Seats et al. ..... 313/584
5,914,563 * 6/1999 Lee et al. ..... 313/585

* cited by examiner

*Primary Examiner*—Ashok Patel
*Assistant Examiner*—Thelma Sheree Clove
(74) *Attorney, Agent, or Firm*—Leydig, Voit, & Mayer, Ltd.

(57) ABSTRACT

A plasma display panel in which common electrode lines, scan electrode lines, and address electrode lines are located between a front substrate and a rear substrate, the substrates facing each other and being spaced apart from each other. The common electrode lines and scan electrode lines are parallel, the address electrode lines are orthogonal to the scan electrode lines and define pixels at each intersection. Partition walls accurately defining a discharge space are parallel to the address electrode lines, and the address electrode lines are divided into at least two parts to be separately driven. The respective partition walls are divided where the address electrode lines are divided to produce passages for gas flow.

2 Claims, 3 Drawing Sheets

PLASMA DISPLAY PANEL OF SEPARATION DRIVE TYPE

BACKGROUND OF THE INVENTION

1. Field of the Invention

The present invention relates to a plasma display panel, and more particularly, to a plasma display panel driven such that it is separated into an upper panel and a lower panel.

2. Description of the Related Art

FIG. 1 shows a three-electrode surface-discharge alternating-current plasma display panel. Referring to the drawing, address electrode lines $A_1, A_2, A_3, \ldots, A_{m-1}$ and $A_m$, a dielectric layer 11, scan electrode lines $Y_1, Y_2, \ldots,$ and $Y_n$, common electrode lines $X_1, X_2, \ldots,$ and $X_n$ and a MgO protective film 12 are provided between front and rear glass substrates 10 and 13 of a surface-discharge plasma display panel 1.

A partition wall 15 and the address electrode lines $A_1, A_2, A_3, \ldots, A_{m-1}$ and $A_m$ coat the entire surface of the rear glass substrate 13 in a parallel pattern. Here, the partition wall 15 partitions a discharge space accurately during the operation of the plasma display panel 1. A phosphor (not shown) may coat the front surface of the address electrode lines $A_1, A_2, A_3, \ldots, A_{m-1}$ and $A_m$. Otherwise, the phosphor may coat a dielectric layer in the event the dielectric layer coats the front surface of the address electrode lines $A_1, A_2, A_3, \ldots, A_{m-1}$ and $A_m$.

The common electrode lines $X_1, X_2, \ldots,$ and $X_n$ and the scan electrode lines $Y_1, Y_2, \ldots,$ and $Y_n$ are arranged on the rear surface of the front glass substrate 10 orthogonal to the address electrode lines $A_1, A_2, A_3, \ldots, A_{m-1}$ and $A_m$ in a predetermined pattern. The respective intersections define corresponding pixels. The dielectric layer 11 is entirely coats the rear surface of the common electrode lines $X_1, X_2, \ldots,$ and $X_n$ and the scan electrode lines $Y_1, Y_2, \ldots,$ and $Y_n$. The MgO protective film 12 for protecting the panel 1 against strong electrical fields entirely coats the rear surface of the dielectric layer 11. A gas for forming a plasma is hermetically sealed in a discharge space 14. The sealing process will now be briefly described. The discharge space 14 is exhausted through an exhaust pipe provided in the discharge space 14 of the sealed panel 1, thereby increasing the degree of vacuum. The gas for forming a plasma is injected into the discharge space 14 through the exhaust pipe and then the exhaust pipe is hermetically sealed.

Referring to FIG. 2, in a conventional plasma display panel of a separation drive type, address electrode lines are divided into upper lines $A_{1U}, A_{2U}, A_{3U}, \ldots, A_{m-1U}$ and $A_{mU}$ and lower lines $A_{1L}, A_{2L}, A_{3L}, \ldots, A_{m-1L}$ and $A_{mL}$ and separately driven, while each partition wall 15 remains without being separated.

According to the conventional plasma display panel of a separation drive type, the vacuum-conductance of the discharge space (14 of FIG. 1) is lowered due to the partition wall 15. Thus, the exhaustion of the discharge space 14 does not occur properly. In particular, impurities remaining in the middle of the partition wall 15 deteriorate the purity of the gas for forming a plasma, thereby degrading the picture quality of the plasma display panel (1 of FIG. 1).

The driving method generally adopted for the plasma display panel described above is an address/display separation driving method in which a reset step, an address step and a sustain discharge step are sequentially performed in a unit sub-field. In the reset step, wall charges remaining in the previous sub-field are erased. In the address step, the wall charges are formed in a selected pixel area. Also, in the sustain discharge step, light is produced at the pixel at which the wall charges are formed in the address step. In other words, if alternating pulses of a relatively high voltage are applied between the common electrode lines $X_1, X_2, \ldots, X_{n-1}$ and $X_n$ and the scan electrode lines $Y_1, Y_2, \ldots, Y_{n-1}$ and $Y_n$, a surface discharge occurs at the pixel at which the wall charges are located. Here, a plasma is formed at the gas layer of the discharge space 14 and the phosphors 142 are excited by ultraviolet rays and emit light.

SUMMARY OF THE INVENTION

To solve the above problem, it is an object of the present invention to provide a plasma display panel driven such that each of address electrode lines is divided into at least two parts, by which the purity of a gas for forming plasma hermetically sealed in a discharge space can be increased.

Accordingly, to achieve the above object, there is provided a plasma display panel in which common electrode lines, scan electrode lines and address electrode lines are arranged between a front substrate and a rear substrate facing each other to be spaced apart from each other, the common electrode lines and scan electrode lines are arranged in parallel, the address electrode lines are arranged to be orthogonal to the scan electrode lines to define pixels at each intersection, partition walls for accurately defining a discharge space are formed to be parallel to the address electrode lines, and the address electrode lines are divided into at least two parts to be separately driven, wherein the respective partition walls are divided at locations where the address electrode lines are divided to produce passages due to spacing.

Pixels are not formed at locations where the address electrode lines are divided. Thus, even if the respective partition walls are divided at these locations, the picture quality is not adversely affected. According to the plasma display panel of the present invention, since the vacuum-conductance of the discharge space is increased by passages formed by division of the partition walls, uniform and smooth exhaustion of the discharge space can occur in the course of manufacturing the plasma display panel. In particular, since no impurity remains in the middle of the partition walls, the purity of the gas for forming plasma is uniformly increased, thereby further improving the picture quality of the plasma display panel.

Preferably, a distance due to spacing between the partitions walls is less than or equal to a distance due to spacing between the address electrode lines. The reason of the foregoing is that there may be no partition wall even in pixel areas if the distance due to spacing between partitions walls is greater than the distance due to spacing between address electrode lines.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 3:
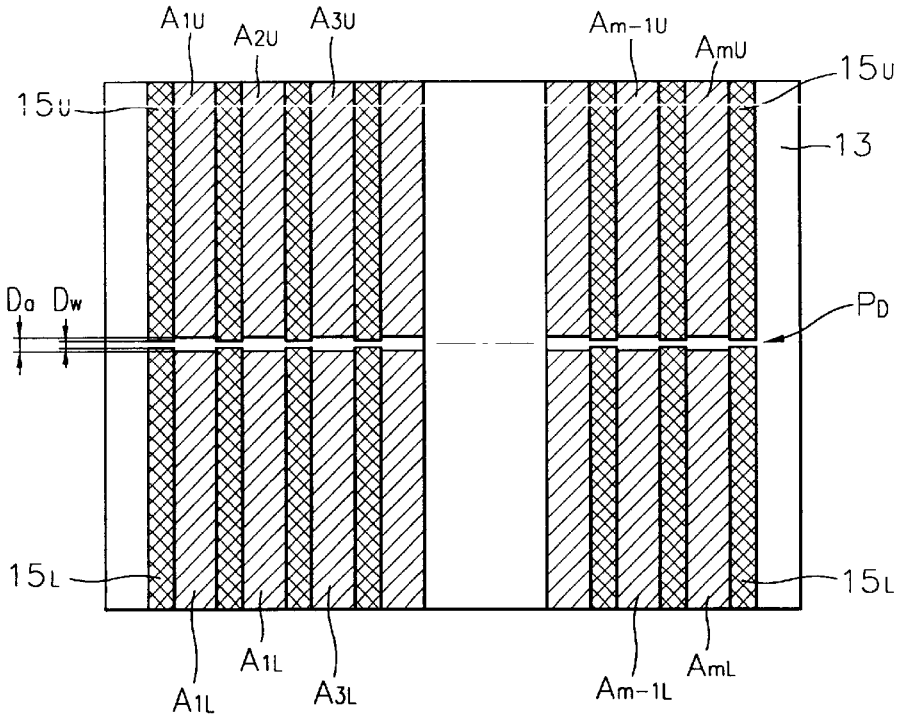
FIG. 3 is a plan view illustrating a rear surface structure of a plasma display panel of a separation drive type according to the present invention.
Figure 4:
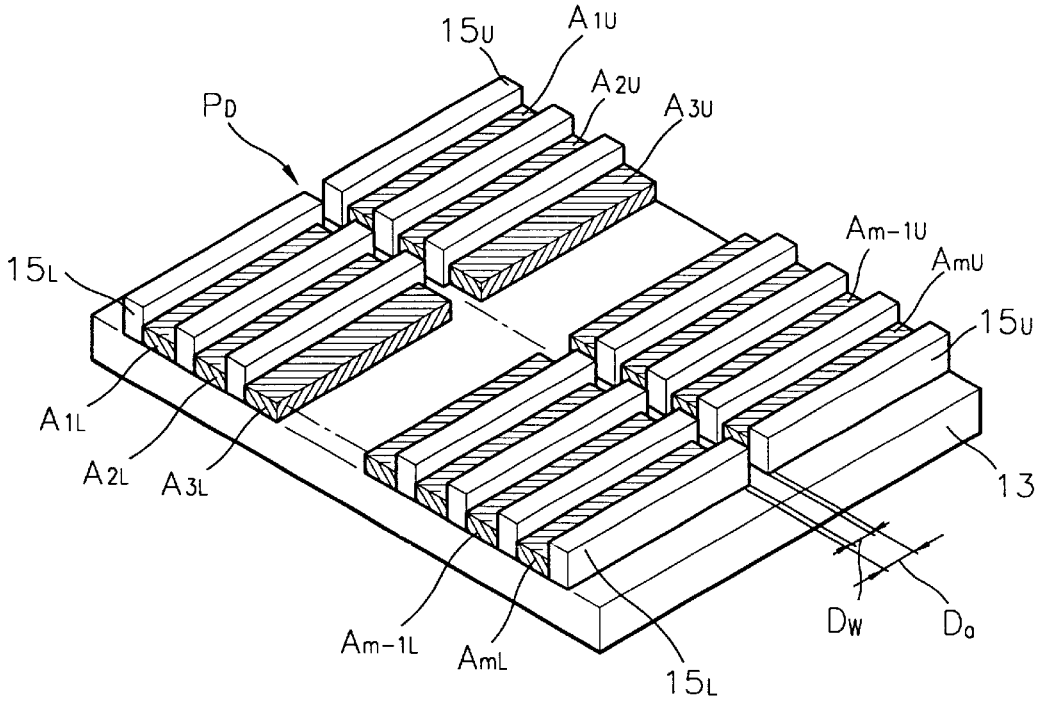
FIG. 4 is a perspective view illustrating a rear surface structure of the plasma display panel shown in FIG. 3.

FIG. 3 illustrates a rear surface structure of a plasma display panel of a separation drive type according to the present invention, and FIG. 4 illustrates a rear surface structure of the plasma display panel shown in FIG. 3.

Referring to FIGS. 3 and 4, in the plasma display panel of a separation drive type according to the present invention, address electrode lines are each divided into two parts, that is, upper lines $A_{1U}$, $A_{2U}$, $A_{3U}$, . . . , $A_{m-1U}$ and $A_{mU}$ and lower lines $A_{1L}$, $A_{2L}$, $A_{3L}$, . . . , $A_{m-1L}$ and $A_{mL}$, on a rear-surface glass substrate 13 and separately driven. Also, partition walls are divided into upper partition walls $^{15}{}_{U}$ and lower partition walls $\mathbf{15}_L$ at locations where the address electrode lines are divided, thereby producing passages due to the spacing therebetween.

A phosphor (not shown) may coat over the front surface of the address electrode lines. Otherwise, the phosphor may coat on a dielectric layer in the event the dielectric layer coats the front surface of the address electrode lines.

Figure 1:
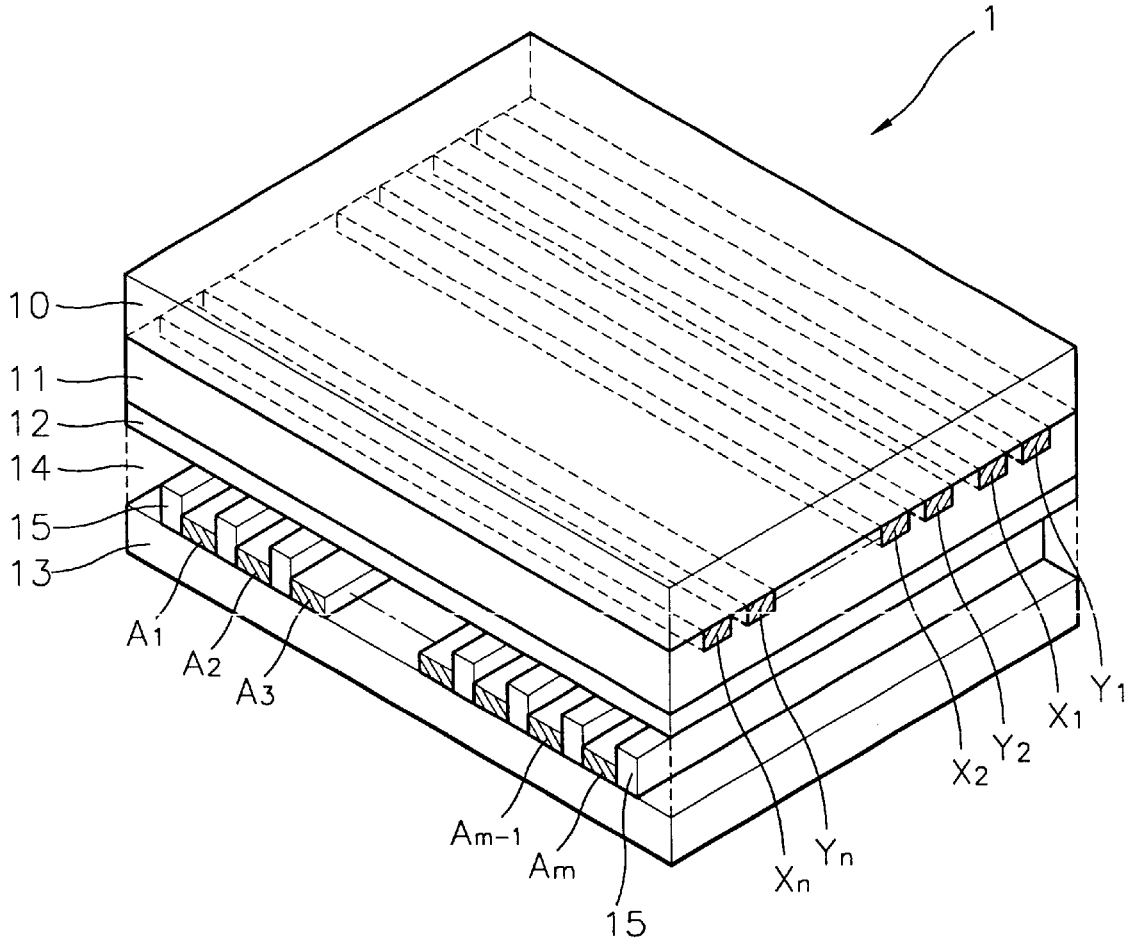
FIG. 1 shows a general three-electrode surface-discharge alternating-current plasma display panel.
Figure 2:
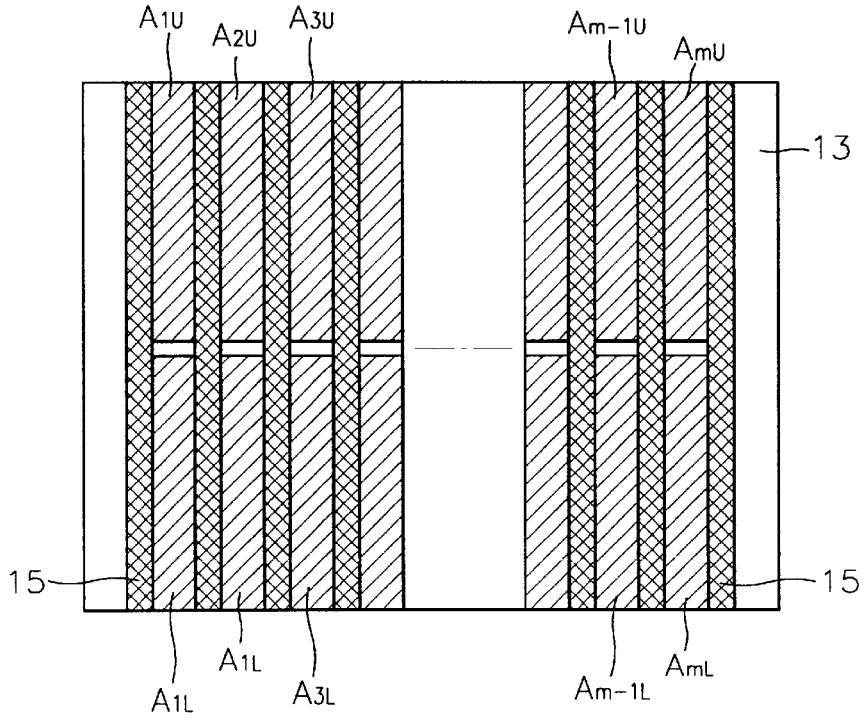
FIG. 2 (PRIOR ART)
FIG. 2 is a plan view of a conventional plasma display panel of a separation drive type.

Pixels are not located at locations PD where the address electrode lines are divided. Thus, even if the respective partition walls are divided at these locations PD, the picture quality is not adversely affected. Also, since the vacuum-conductance of the discharge space (14 of FIG. 1) is increased the passages formed by division of the partition walls into upper partition walls $\mathbf{15}_U$ and lower partition walls $\mathbf{15}_L$, uniform and smooth evacuation of the discharge space can occur in the course of manufacturing the plasma display panel. In particular, since no impurity remains in the middle of the partition walls due to division, the purity of the gas for forming plasma is uniformly increased, thereby further improving the picture quality of the plasma display panel (1 of FIG. 1).

A distance $D_W$ due to spacing between partitions walls is less than or equal to a distance $D_a$ due to spacing between address electrode lines. The reason for the foregoing is that if the distance $D_W$ is greater than the distance $D_a$, the partition walls $\mathbf{15}_U$ and $\mathbf{15}_L$ may vanish even at pixel areas.

Figure 5:
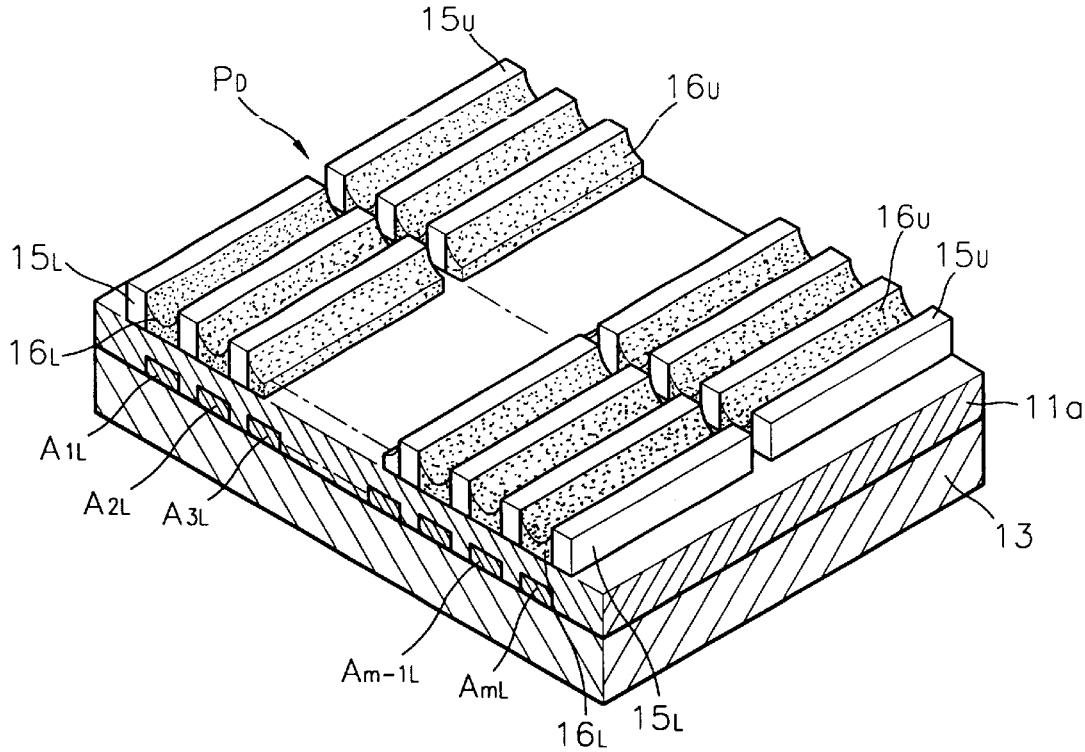
FIG. 5 is a perspective view illustrating another rear surface structure of the plasma display panel shown in FIG. 3.

FIG. 5 illustrates another rear surface structure of the plasma display panel shown in FIG. 3.

Referring to FIG. 5, in the plasma display panel of a separation drive type, address electrode lines are each divided into two parts, that is, upper lines $A_{1U}$, $A_{2U}$, $A_{3U}$, . . . , $A_{m-1U}$ and $A_{mU}$ and lower lines $A_{1L}$, $A_{2L}$, $A_{3L}$, . . . , $A_{m-1L}$ and $A_{mL}$, on a rear-surface glass substrate 13 and the separately driven. Also, partition walls are divided into upper partition walls $\mathbf{15}_U$ and lower partition walls $\mathbf{15}_L$ at locations where the address electrode lines are divided, thereby producing passages due to spacing therebetween.

A dielectric layer 11*a* coats on front surfaces and side surfaces of the address electrode lines. Also, on the front surface of the dielectric layer 11*a*, partition walls are divided into upper partition walls $\mathbf{15}_U$ and lower partition walls $\mathbf{15}_L$ at locations $P_D$ where the address electrode lines are divided, thereby producing passages due to spacing therebetween. An upper phosphor coating $\mathbf{16}_U$ is present between the upper partition walls $\mathbf{15}_U$. Likewise, a lower phosphor coating $\mathbf{16}_L$ is coated between the lower partition walls $\mathbf{15}_L$, The operation and effect of the present invention for the rear surface structure shown in FIG. 5 are the same as those described with reference to FIGS. 3 and 4.

As described above, according to the plasma display panel of the present invention, the vacuum-conductance of a discharge space is increased by passages produced by division of partition walls, thereby achieving uniform and smooth evacuation of the discharge space in the course of manufacturing the plasma display panel. In particular, since no impurity remains in the middle of partition walls, the purity of a gas for forming a plasma is uniformly enhanced, thereby further increasing the picture quality of the plasma display panel.

Although the invention has been described with respect to a preferred embodiment, it is not to be so limited as changes and modifications can be made which are within the full intended scope of the invention as defined by the appended claims.

What is claimed is:

1. A plasma display panel including:

front and rear substrates;

common electrode lines, scan electrode lines, and address electrode lines arranged between a the front substrate and the rear substrate, the front and rear substrates facing each other and spaced apart from each other, the common electrode lines and scan electrode lines being parallel, the address electrode lines being orthogonal to the scan electrode lines and defining a pixel at each intersection; and partition walls for accurately defining a discharge space, parallel to the address electrode lines, the address electrode lines being divided into at least two parts to be separately driven, wherein the respective partition walls are divided at locations where the address electrode lines are divided, producing fluid passages due to spacing between divided partition walls.

2. The plasma display panel according to claim 1, wherein distance due to spacing between the partitions walls is no larger than spacing between the address electrode lines.

* * * * *